US011842712B2

(12) United States Patent
Grant

(10) Patent No.: US 11,842,712 B2
(45) Date of Patent: Dec. 12, 2023

(54) METHODS OF PROVIDING PRECISE TUNING OF MUSICAL INSTRUMENTS

(71) Applicant: Crown Sterling Limited, LLC, Newport Beach, CA (US)

(72) Inventor: Robert Edward Grant, Laguna Beach, CA (US)

(73) Assignee: Crown Sterling Limited, LLC, Newport Beach, CA (US)

( * ) Notice: Subject to any disclaimer, the term of this patent is extended or adjusted under 35 U.S.C. 154(b) by 194 days.

(21) Appl. No.: 17/132,374

(22) Filed: Dec. 23, 2020

(65) Prior Publication Data

US 2022/0199058 A1 Jun. 23, 2022

(51) Int. Cl.
*G10H 1/44* (2006.01)
*G10H 1/26* (2006.01)
*G10H 7/06* (2006.01)

(52) U.S. Cl.
CPC ..... *G10H 1/44* (2013.01); *G10H 1/26* (2013.01); *G10H 7/06* (2013.01); *G10H 2210/066* (2013.01)

(58) Field of Classification Search
CPC .. G10H 1/44; G10H 1/26; G10H 7/06; G10H 2210/066
USPC ..... 84/601
See application file for complete search history.

(56) References Cited

U.S. PATENT DOCUMENTS 4,166,405 A * 9/1979 Hiyoshi ..... G10H 1/0575 84/669
4,860,624 A * 8/1989 Dinnan ..... G10H 1/20 84/613
5,516,981 A * 5/1996 Nagai ..... G10C 3/12 84/451
6,448,487 B1 * 9/2002 Smith ..... G10H 3/186 84/613
6,924,426 B2 * 8/2005 Clynes ..... G10H 1/44 84/649
11,532,293 B2 * 12/2022 Beasley ..... G10H 1/366
2004/0200335 A1 * 10/2004 Phillips ..... G10H 1/0008 84/483.2
2008/0006140 A1 * 1/2008 Adams ..... G10D 3/04 84/455
2008/0184872 A1 * 8/2008 Hunt ..... G10H 1/02 84/645
2008/0257136 A1 * 10/2008 Meeks ..... G10H 1/342 84/727
2016/0042657 A1 * 2/2016 Granger ..... G10H 1/0008 84/477 R (Continued)

FOREIGN PATENT DOCUMENTS

AU 2010230035 A1 * 11/2011 ..... A61N 1/36036
DE 102018005247 A1 * 1/2020

(Continued)

OTHER PUBLICATIONS

International Search Report dated Apr. 20, 2022, from related application No. PCT/US21/64739. 14 pages.

*Primary Examiner* — Christina M Schreiber
(74) *Attorney, Agent, or Firm* — Fish IP Law, LLP

(57) ABSTRACT

An improved tuning method for fixed interval musical instruments is provided. This Precise Temperament tuning method provide mathematically consistent intervals between notes to prevent dissonance within chords while retaining the esthetics of pure tones associated with Western music.

9 Claims, 5 Drawing Sheets

(56) References Cited

U.S. PATENT DOCUMENTS

| | | | | |
|---|---|---|---|---|
| 2019/0051276 | A1* | 2/2019 | Lathrop | G10G 1/02 |
| 2021/0065664 | A1* | 3/2021 | Ryynänen | G10G 7/02 |
| 2022/0199058 | A1* | 6/2022 | Grant | G10H 1/26 |

FOREIGN PATENT DOCUMENTS

| | | | | | |
|---|---|---|---|---|---|
| FR | 2679365 | A1 | * | 1/1993 | G10G 7/02 |
| JP | 2002529774 | A | * | 9/2002 | |
| JP | 2014026213 | A | | 2/2014 | |
| KR | 20010008976 | A | | 2/2001 | |
| KR | 20130051386 | A | * | 5/2013 | |
| KR | 20130051386 | A | | 5/2013 | |
| KR | 101605496 | B1 | | 3/2016 | |
| WO | WO-9720306 | A1 | * | 6/1997 | G10C 3/12 |
| WO | WO-2010111320 | A2 | * | 9/2010 | A61N 1/36036 |

* cited by examiner 1. 144.027072hz, 288.054144hz, 576.108288hz
2. 257.2395519456hz, 514.4791038912hz
3. 216.040608hz, 432.081216hz
4. 362.88hz, 725.76hz
5. 272.21116608hz, 544.42233216hz
6. 648.24367090912hz, 1,296.48734181824hz
7. 544.42233216hz
8. 457.2288hz, 914.4576hz
9. 486.091368hz, 972.182736hz
10. 816.63349824hz, 1,633.26699648hz
11. 685.9721385216hz, 1,371.9442270432hz
12. 576.108288hz, 1,152.216576hz
13. 1,028.9582077824hz, 2,057.9164155648hz

METHODS OF PROVIDING PRECISE TUNING OF MUSICAL INSTRUMENTS

FIELD OF THE INVENTION

The field of the invention is methods of tuning a musical instrument, specifically intervals used in the generation of scales.

BACKGROUND

The following description includes information that may be useful in understanding the present invention. It is not an admission that any of the information provided herein is prior art or relevant to the presently claimed invention, or that any publication specifically or implicitly referenced is prior art.

Western music is based on the concept of an octave interval, which is understood to represent a doubling of the frequency corresponding to the note that forms the basis of a designated chord. Conventional musical notation provides distinct notes representing distinct tones or frequencies within such an octave. For example, a chromatic scale in Western music provides 12 distinct notes or frequencies within an octave, with the twelfth note (or octave) designated as having twice the frequency of the first note. These are referred to as the unison (the base or fundamental tone), the minor second, the major second, the minor third, the major third, the fourth, the diminished fifth, the fifth, the minor sixth, the major sixth, the minor seventh, the major seventh, and the octave (which has a frequency twice that of the unison).

Ideally the intervals between individual notes of the chromatic scale is consistent and provides for the generation of chords or combinations of notes that are pleasing to the ear, despite being transposed between different keys or being produced by instruments that provide tones in very different ranges. The division of the octave into distinct and evenly spaced notes has, however, introduced certain difficulties in tuning of musical instruments within such notation systems.

It is not clear why some combinations of notes sound harmonious and are pleasing to the ear. That being said, combinations of notes with frequencies that are even slightly "off" will sound dissonant or generate an undesirable "beat" pattern when played together. Accordingly, a number of different tuning systems have been implemented that attempt to provide consistent harmony when applied across a wide range of octaves.

One classic tuning system utilizes simple ratios of whole numbers that are applied as multipliers to the frequency representing the fundamental note. This is referred to as a Just Scale. In a Just Scale the minor second has a frequency that is 25/24 times that of unison, the major second has a frequency that is 9/8 times that of unison, the minor third has a frequency that is 6/5 times that of unison, the major third has a frequency that is 5/4 times that of unison, the fourth has a frequency that is 4/3 times that of unison, the diminished fifth has a frequency that is 45/32 times that of unison, the fifth has a frequency that is 3/2 times that of unison, the minor sixth has a frequency that is 8/5 times that of unison, the major sixth has a frequency that is 5/3 times that of unison, the minor seventh has a frequency that is 9/5 times that of unison, and the major seventh has a frequency that is 15/8 times that of unison.

The shortcoming of Just Scale tuning is that the intervals between individual note elements are only approximately equal. Accordingly, a designated not (say, C sharp) generated by following the Just Scale intervals starting at one unison or fundamental tone may not have the same frequency as a C sharp generated following the Just Scale intervals starting from a second unison or fundamental tone. While the difference may be relatively minor it is readily perceptible when the two slightly different C sharps are played together. Similarly, note designations that should be identical (e.g., C sharp/D flat, A sharp/B flat, G sharp/A flat, etc.) will not be at the same frequency when derived from different unison or fundamental tone.

There are a variety of ways to address this issue. Although the limits of the ranges produced vary between individuals, the human voice can produce a wide and continuous range of frequencies utilizable in vocal music. Vocalists are, therefore, free to adjust their individual pitches slightly and "by ear" during a performance in order to avoid dissonance. Certain musical instruments can similarly provide a continuous range of frequencies within the limits of their design and the skill of their players. Examples include string instruments such as the violin, viola, and cello (which are not provided with frets) and the slide trombone (which has a slide that provides continuously adjustable instrument length). Musicians playing such instruments can adjust their fingering or slide positions by ear while performing to avoid dissonance. Success with such approaches is necessarily a function of individual skill.

Other instruments, however, are designed to provide notes at fixed intervals from one another. Keyboard instruments such as the piano, organ, and accordion have distinct keys that are pressed to actuate a set of strings, pipes, or reeds that each produce a fixed frequency. String instruments with frets are similarly limited to generating specific fixed frequencies by the position of the frets along the string being sounded. Most wind instruments are limited to specific frequencies generated by covering or uncovering a defined set of openings along the length of the instrument or actuating valves that connect to specific lengths of tubing. Musicians playing such instruments can, under some circumstances, alter the pitch of a note slightly during performance using various techniques, however the degree of adjustment is limited and the results are highly dependent upon the skill of the instrumentalist.

One approach to resolving this issue with fixed interval instruments is to use an alternative tuning system, which in turn can be reflected in tuning or construction of the fixed interval instruments. Equal Temperament tuning is an example of such an alternative tuning system. Equal Temperament tuning is a geometric progression based on the 12th root of 2, applied to the unison or fundamental tone. In Equal Temperament tuning the minor second has a frequency that is $12/1\sqrt{2}$ (i.e. the twelfth root of 2) times that of unison, the major second has a frequency that is $12/2\sqrt{2}$ times that of unison, the minor third has a frequency that is $12/3\sqrt{2}$ times that of unison, the major third has a frequency that is the $12/4\sqrt{2}$ times that of unison, the fourth has a frequency that is $12/5\sqrt{2}$ times that of unison, the diminished fifth has a frequency that is $12/6\sqrt{2}$ times that of unison, the fifth has a frequency that is $12/7\sqrt{2}$ times that of unison, the minor sixth has a frequency that is $12/8\sqrt{2}$ times that of unison, the major sixth has a frequency that is $12/9\sqrt{2}$ times that of unison, the minor seventh has a frequency that is $12/10\sqrt{2}$ times that of unison, and the major seventh has a frequency that is $12/11\sqrt{2}$ times that of unison. The next step in the series, a frequency that is $12/12\sqrt{2}$ (i.e., 2) times that of unison provides the octave. While mathematically consistent and relatively straightforward to implement, many musicians are not satisfied with it as it lacks "pure" intervals.

U.S. Pat. No. 4,860,624, to Dinnan and Dinnan, describes a "TruScale" system that applies a regular progression of fixed, but apparently arbitrary, frequency intervals to generate a progression of notes based on a fundamental tone, as well as application of this system to an electronic instrument. All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply. It is not clear how effective this approach is at avoiding dissonance and loss of pure intervals, or how it could be implemented across a range of different instruments having different fundamental frequencies.

U.S. Pat. No. 6,448,487 (to Smith), describes an approach that essentially reverses the problem. The patent describes a system based on conventional 12 note scales, with storage of various intervals, where the frequencies of one note being produced are adjusted to be a harmonic of another note being played at the same time based on computer-implemented identification of the probable chord type. This is, essentially, an attempt to emulate adjustments made by an instrumentalist to avoid dissonance. It is not clear how this approach could be implemented in a group performance or with conventional (i.e., non-electronic) instruments.

Thus, there is still a need for tuning method that provides mathematical regularity while also accommodating pure intervals necessary for esthetics.

SUMMARY OF THE INVENTION

The inventive subject matter provides a tuning method that provides regular intervals between tones of a chord or scale while preserving the esthetics of pure intervals, application of such a tuning method to correction or adjustment of a musical note, application of the tuning method to various classes of musical instruments, and musical instruments embodying the tuning method.

One embodiment of the inventive concept is a method of adjusting a musical note by identifying a fundamental note or base note comprising or characterized by a fundamental note frequency, generating a major second note comprising or characterized by a major second note frequency from the fundamental note by multiplying the fundamental note frequency by 1.125 to generate the major second note frequency, generating a major third note comprising or characterized by a major third note frequency from the fundamental note by multiplying the fundamental note frequency by 1.26 to generate a major third note frequency, and generating a fifth note comprising or characterized by a fifth note frequency from the fundamental tone by multiplying the fundamental tone frequency by 1.5 to generate the fifth note frequency. The fundamental note frequency, the major second note frequency, the major third note frequency, and the fifth note frequency are stored in a memory, such as a computer memory device. A first input note frequency is identified as corresponding to the fundamental note, then a memory location where the fundamental note frequency is stored is identified and the fundamental note frequency transmitted to an audio emitter or a storage medium. Second, third, and fourth input note frequencies are also identified as corresponding to second, third, and fourth notes (respectively). The memory locations for the corresponding second, third, and fourth note frequencies are then identified and the second, third, and fourth note frequencies transmitted from the memory to the audio emitter or storage medium. The first input note frequency, the second input note frequency, the third input note frequency, and the fourth input note frequency can be obtained from a recording medium and/or a microphone (or equivalent device).

In some embodiment the method also includes generating a fourth note comprising or characterized by a fourth note frequency from the fundamental note by multiplying the fundamental note frequency by 1.333 to generate a fourth note frequency, storing the fourth note frequency in the memory, and identifying a fifth input note frequency as corresponding to the fourth note. The memory location where the fourth note frequency is stored is accessed, and the fourth note frequency is transmitted from the memory to the audio emitter and/or the storage medium. The fifth input note frequency can be obtained from a recording medium or a microphone.

Some embodiments of the method include generating a minor second note comprising or characterized by a minor second note frequency from the fundamental note by multiplying the fundamental note frequency by 1.058 to generate the minor second frequency, generating a minor third note comprising or characterized by a minor third note frequency from the fundamental tone by multiplying the fundamental note frequency by 1.190 to generate the minor third note frequency, generating a diminished fifth note comprising or characterized by a diminished fifth note frequency from the fundamental note by multiplying the fundamental note frequency by 1.414 to generate the diminished fifth note frequency, generating a minor sixth note comprising or characterized by a minor sixth note frequency from the fundamental note by multiplying the fundamental note frequency by 1.587 to generate the minor sixth note frequency, generating a major sixth note comprising or characterized by a major sixth note frequency from the fundamental note by multiplying the fundamental note frequency by 1.68 to generate the major sixth note frequency, generating a minor seventh note comprising or characterized by a minor seventh note frequency from the fundamental note by multiplying the fundamental note frequency by 1.786 to generate the minor seventh note frequency, and generating a major seventh note comprising or characterized by a major seventh note frequency from the fundamental note by multiplying the fundamental note frequency by 1.889 to generate the major seventh note frequency. The minor second note frequency, the minor third note frequency, the diminished fifth note frequency, the minor sixth note frequency, the major sixth note frequency, the minor seventh note frequency, and the major seventh note frequency are stored the memory. When a sixth input note frequency is identified as corresponding to the minor second note the memory location where the minor second note frequency is stored is accessed, and the minor second note frequency is transmitted from the memory to an audio emitter or a storage medium. When a seventh input note frequency is identified as corresponding to the minor third note the memory location where the minor third note frequency is stored is accessed, and the minor third note frequency is transmitted from the memory to an audio emitter or a storage medium. When an eighth input note frequency is identified as corresponding to the diminished fifth note the memory location where the diminished fifth note frequency is stored is accessed, and the diminished fifth note frequency is transmitted from the memory to an audio emitter or a storage medium. When a ninth input note frequency is identified as corresponding to the minor sixth note the memory location where the minor sixth note frequency is stored is accessed, and the minor sixth note frequency is transmitted from the memory to an audio emitter or a storage medium. When a tenth input note frequency is identified as corresponding to the major sixth note the memory location where the major sixth note frequency is stored is accessed, and the major sixth note frequency is transmitted from the memory to an audio emitter or a storage medium. When an eleventh input note frequency is identified as corresponding to the minor seventh note the memory location where the minor seventh note frequency is stored is accessed, and the minor seventh note frequency is transmitted from the memory to an audio emitter or a storage medium. When a twelfth input note frequency is identified as corresponding to the major seventh note the memory location where the major seventh note frequency is stored is accessed, and the major seventh note frequency is transmitted from the memory to an audio emitter or a storage medium. The sixth input note frequency, the seventh input note frequency, the eighth input note frequency, the ninth input note frequency, the tenth input note frequency, the eleventh input note frequency, and the twelfth input note frequency can be obtained from a microphone or a storage medium.

Another embodiment of the inventive concept is a method of tuning a fixed interval musical instrument by identifying a fundamental note of the fixed interval musical instrument, where the fundamental note comprises or is characterized by a fundamental note frequency, generating a major second note comprising or characterized by a major second note frequency from the fundamental note by multiplying the fundamental note frequency by 1.125 to generate the major second note frequency, generating a major third note comprising or characterized by a major third note frequency from the fundamental note by multiplying the fundamental note frequency by 1.26 to generate a major third note frequency, and generating a fifth note comprising or characterized by a fifth note frequency from the fundamental tone by multiplying the fundamental tone frequency by 1.5 to generate the fifth note frequency. A first fixed interval of the fixed interval musical instrument to is configured generate the major second note frequency. A second fixed interval of the fixed interval musical instrument is configured to generate the major third note frequency and a third fixed interval of the fixed interval musical instrument is configured to generate the fifth note frequency. Embodiments of the inventive concept include musical instruments that are constructed or adjusted (for example, by tuning mechanisms) to reflect such a method.

In some embodiments such a method can include generating a fourth note comprising or characterized by a fourth note frequency from the fundamental note by multiplying the fundamental note frequency by 1.333 to generate a fourth note frequency, and configuring a fourth fixed interval of the fixed interval musical instrument to generate the fifth note frequency. Embodiments of the inventive concept include musical instruments that are constructed or adjusted (for example, by tuning mechanisms) to reflect such a method.

In some embodiments generating a minor second note comprising or characterized by a minor second note frequency from the fundamental note by multiplying the fundamental note frequency by 1.058 to generate the minor second frequency, generating a minor third note comprising or characterized by a minor third note frequency from the fundamental tone by multiplying the fundamental note frequency by 1.190 to generate the minor third note frequency, generating a diminished fifth note comprising or characterized by a diminished fifth note frequency from the fundamental note by multiplying the fundamental note frequency by 1.414 to generate the diminished fifth note frequency, generating a minor sixth note comprising or characterized by a minor sixth note frequency from the fundamental note by multiplying the fundamental note frequency by 1.587 to generate the minor sixth note frequency, generating a major sixth note comprising or characterized by a major sixth note frequency from the fundamental note by multiplying the fundamental note frequency by 1.68 to generate the major sixth note frequency, generating a minor seventh note comprising or characterized by a minor seventh note frequency from the fundamental note by multiplying the fundamental note frequency by 1.786 to generate the minor seventh note frequency, and generating a major seventh note comprising or characterized by a major seventh note frequency from the fundamental note by multiplying the fundamental note frequency by 1.889 to generate the major seventh note frequency. A fifth fixed interval of the fixed interval musical instrument is configured to generate the minor second note frequency. A sixth fixed interval of the fixed interval musical instrument is configured to generate the minor third note frequency. A seventh fixed interval of the fixed interval musical instrument is configured to generate the diminished fifth note frequency. An eighth fixed interval of the fixed interval musical instrument is configured to generate the minor sixth note frequency. A ninth fixed interval of the fixed interval musical instrument is configured to generate the major sixth note frequency. A tenth fixed interval of the fixed interval musical instrument is configured to generate the minor seventh note frequency. An eleventh fixed interval of the fixed interval musical instrument is configured to generate the major seventh note frequency. Embodiments of the inventive concept include musical instruments that are constructed or adjusted (for example, by tuning mechanisms) to reflect such a method.

In some embodiments such a fixed interval musical instrument is a string instrument, where the first, second, and third fixed intervals comprise or are embodied as a series of strings or wires. In such embodiments the series of strings comprise a first, second, third, and fourth strings can have lengths configured to generate and/or be tensioned to generate the fundamental note frequency, the major second note frequency, the major third note frequency, and the fifth note frequency, respectively, when set into vibrational motion. In some embodiments the string instrument includes fixed intervals in the form of a neck comprising a plurality of frets, and a plurality of strings arranged along the neck and positioned to be brought into contact with the frets by a user. In such embodiments a subset of the plurality of frets are arranged to effectively modify the lengths of one or more of the plurality of strings when the one or more of the plurality of strings are pressed against one or more of the subset of frets by a user. The subset of the plurality of frets is arranged along the neck to generate one or more of the major second note frequency, the major third note frequency, and the fifth note frequency when the one or more of the plurality of strings as selected by the user are impelled into the one or more of the subset of frets and set into vibrational motion. Embodiments of the inventive concept include musical instruments that are constructed or adjusted (for example, by tuning mechanisms) to reflect such a method.

In some embodiments the fixed interval musical instrument is a wind instrument. Such a wind instrument can include a mouthpiece configured to provide an oscillating air pressure and a wall that encloses an air column that is in fluid communication with the oscillating air pressure. This provides a vibrating air column that generates sound. The wall can include a plurality of apertures, and the effective length of the air column is modified by obstructing one or more aperture. The plurality of apertures can include a first, second, and third configurations of obstructed apertures that provide a series of effective lengths of the vibrating air column, which are effective to generate the major second note frequency, the major third note frequency, and the fifth note frequency. Embodiments of the inventive concept include musical instruments that are constructed or adjusted (for example, by tuning mechanisms) to reflect such a method.

In some embodiments such a wind instrument can include a mouthpiece configured to provide an oscillating air pressure and a wall that encloses a primary air column that is in fluid communication with the oscillating air pressure. This provides a vibrating air column that generates sound. A first valve is in fluid communication with the vibrating air column and with a first tube, such that actuation of the first valve places the primary air column in communication with the first tube. A second valve is in fluid communication with the vibrating air column and with a second tube, such that actuation of the second valve places the primary air column in communication with the second tube. A third valve is in fluid communication with the vibrating air column and with a third tube, such that actuation of the third valve places the primary air column in communication with the third tube. The first, second, and third valves and first, second, and third tubes are configured to provide a first, second, and third configurations of fluidic connections between the primary air column and the first, second, and third tubes and provide a series of effective lengths of the vibrating air column that generate the major second frequency, the major second note frequency, the major third note frequency, and the fifth note frequency. Embodiments of the inventive concept include musical instruments that are constructed or adjusted (for example, by tuning mechanisms) to reflect such a method.

In some embodiments the fixed interval musical instrument is a percussion instrument comprising a plurality of percussive surfaces. In such embodiments a subset of the plurality percussive surfaces are dimensioned and/or tensioned to generate the major second note frequency, the major third note frequency, and the fifth note frequency when selected members of the subset of the plurality of percussive surfaces are struck by a user. Embodiments of the inventive concept include musical instruments that are constructed or adjusted (for example, by tuning mechanisms) to reflect such a method.

In some embodiments the fixed interval musical instrument is an electronic instrument comprising one or more oscillators. In some of such embodiments the electronic instrument includes a first oscillator and a second oscillator, wherein the first and second oscillators are configured to generate two or more of the major second note frequency, the major third note frequency, and the fifth note frequency. In some embodiments the electronic instrument includes at least one oscillator that is configured to generate two or more of the major second note frequency, the major third note frequency, and the fifth note frequency. Embodiments of the inventive concept include musical instruments that are constructed or adjusted (for example, by tuning mechanisms) to reflect such a method. Such an electronic instrument can be a virtual instrument, such as a virtual instrument that is embodied as an application on a portable electronic device.

Various objects, features, aspects and advantages of the inventive subject matter will become more apparent from the following detailed description of preferred embodiments.

BRIEF DESCRIPTION OF THE DRAWINGS

FIG. 1 depicts interrelationships between the note elements of a chromatic scale using a prior art tuning system referred to as Just Scale tuning.

FIG. 2 depicts interrelationships between the note elements of a chromatic scale using a prior art tuning system referred to as Equal Temperament tuning.

FIG. 3 depicts interrelationships between the note elements of a chromatic scale using an embodiment of the inventive concept, Precise Temperament tuning, within a single octave.

FIG. 4 depicts interrelationships between the note elements of a chromatic scale using an embodiment of the inventive concept, Precise Temperament tuning, across multiple octaves and demonstrating generation of chords. Frequencies for associated notes are provided in Herz.

FIG. 5 schematically depicts an exemplary method of the inventive concept.

DETAILED DESCRIPTION

Figure 1:
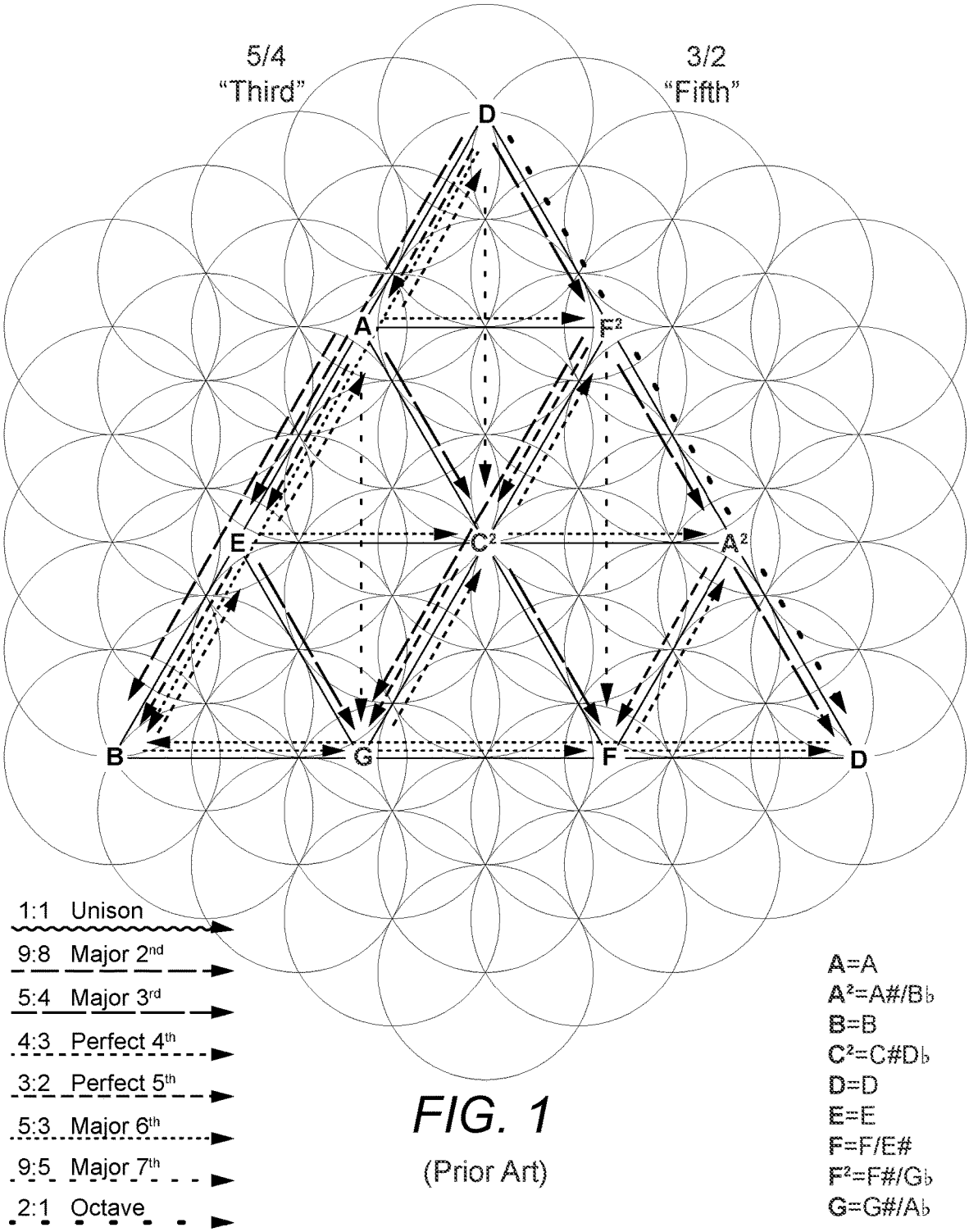
FIG. 1 (Prior Art)
FIG. 1.

Inventors have devised a novel tuning system (i.e., the Precise Temperament tuning system) that can generate a consistent pitch or frequency for each of a minor second, major second, minor third, major third, fourth, diminished fifth, minor sixth, major sixth, minor seventh, major seventh, and octave notes or frequencies derived from a starting or fundamental tone. Specified multipliers of the frequency of the starting or fundamental tone are provided that generate these derivative notes do not generate undesirable dissonance when played as a chord, but maintain the esthetics of "pure" intervals generated by classical whole number ratio tuning methods. Similarly, such derivative notes do not generate undesirable dissonance when played in unison between different musical instruments designed or tuned to implement the specified frequency multipliers, particularly where such instruments have different fundamental tones. The method is advantageously applied to fixed interval musical instruments.

The Inventor also contemplates fixed interval musical instruments that are designed and/or constructed such that the fixed intervals they provide reflect the specified frequency multipliers. Examples of such fixed interval musical instruments include keyboard instruments, fretted string instruments, woodwind instruments with keys, brass instruments with valves, certain percussion instruments that produce different and defined tones, and electronic instruments.

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Within the context of this application a fixed interval musical instrument should be understood as a musical instrument that is constructed to produce notes at discrete and fixed intervals (following tuning) from a fundamental pitch, tone, and/or frequency of the instrument. Such instruments can provide a number of sound-producing elements, such as a set of strings, wires, pipes, reeds, percussive surfaces, etc., that are each assigned to a specific note, any one of which can be selected as producing the fundamental pitch or frequency, although this is often dictated by convention. For example, middle C on a piano keyboard is generally accepted as the instrument's fundamental pitch or frequency. Alternatively, a fixed interval musical instrument can provide one or a small number (i.e., 10 or fewer) sound producing elements the tone or frequency of which can be modified through the actions of a user. In such instruments a fundamental pitch or frequency is generally a pitch or frequency produced when the user is not taking action to modify the pitch or tone. For example, an A produced by an oboe when none of the keys are in use is typically considered the instrument's fundamental tone. Similarly, the pitch or tone produced by a selected string of a fretted string instrument when the user is not depressing the selected string into any fret can be considered the instrument's fundamental pitch or tone.

Table 1 shows the frequency multipliers or "intervals" used to generate the notes of a chromatic scale based on a unison or fundamental note or frequency for conventional Just tuning (which can provide classic "pure" tones) and Equal Temperance tuning. Unison refers to the starting note, tone, pitch, and/or frequency of the scale. Octave refers to a doubling of the Unison frequency, which the human ear perceives as the same note at a higher pitch. Each of the intermediate notes is specified by their conventional designations in chord structures of Western music.

TABLE 1

| Note | Just tuning | Equal Temperance tuning |
|---|---|---|
| Unison | 1.0000 | 1.00000 |
| Minor Second | $^{25}/_{24}$ = 1.0417 | $\sqrt[12/1]{2}$ = 1.05946 |
| Major Second | $^{9}/_{8}$ = 1.1250 | $\sqrt[12/2]{2}$ = 1.12246 |
| Minor Third | $^{6}/_{5}$ = 1.2000 | $\sqrt[12/3]{2}$ = 1.18921 |
| Major Third | $^{5}/_{4}$ = 1.2500 | $\sqrt[12/4]{2}$ = 1.25992 |
| Fourth | $^{4}/_{3}$ = 1.3333 | $\sqrt[12/5]{2}$ = 1.33483 |
| Diminished Fifth | $^{45}/_{32}$ = 1.4063 | $\sqrt[12/6]{2}$ = 1.41421 |
| Fifth | $^{3}/_{2}$ = 1.5000 | $\sqrt[12/7]{2}$ = 1.49831 |
| Minor Sixth | $^{8}/_{5}$ = 1.6000 | $\sqrt[12/8]{2}$ = 1.58740 |
| Major Sixth | $^{5}/_{3}$ = 1.6667 | $\sqrt[12/9]{2}$ = 1.68179 |
| Minor Seventh | $^{9}/_{5}$ = 1.8000 | $\sqrt[12/10]{2}$ = 1.78180 |
| Major Seventh | $^{15}/_{8}$ = 1.8750 | $\sqrt[12/11]{2}$ = 1.88775 |
| Octave | 2.0000 | $\sqrt[12/12]{2}$ = 2.0000 |

Figure 2:
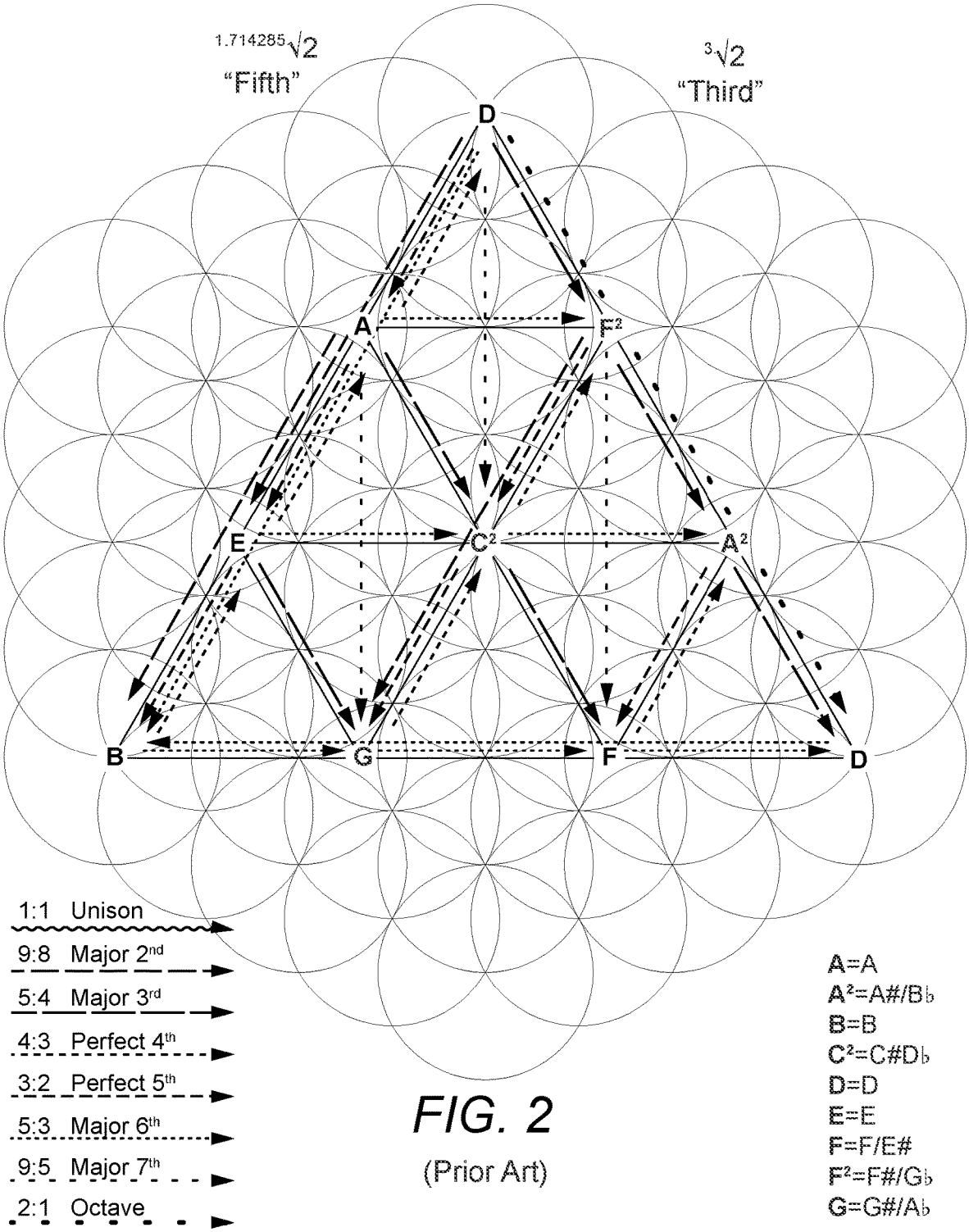
FIG. 2 (Prior Art)
FIG. 2.

Application of the Just intervals to generate the note series representing a C chromatic scale is shown in FIG. 1. Application of the Equal Temperance intervals to generate the note series representing a C chromatic scale is shown in FIG. 2. It should be appreciated that these intervals can be applied to notes of the chromatic scale to, in theory, derive other notes through the application of these tuning intervals. Issues arise in the use of Just tuning intervals in that the frequencies of what should be identical notes or tones derived from different notes within the series are not identical. For example, raising the tuning interval used to generate the "major third" to the third power should generate the octave (which should have a frequency that is precisely twice that of the unison tone or note). However, $1.25^3=1.9531$. While the difference from 2.0000 may seem minor it is very audible. Accordingly, chords generated from such combinations can generate unpleasant dissonance when such notes are combined. Use of the Equal Temperance intervals avoids this issue, however many musicians find the lack of "pure" tones esthetically displeasing.

The Applicant has devised a novel set of tuning method (i.e., Precise Temperament) that resolves the problems encountered with prior art tuning systems. Table 2 shows the frequency multipliers or "intervals" used to generate the notes of a chromatic scale based on a unison or fundamental note or frequency for Precise Temperament tuning, which can provide classic "pure" tones while avoiding unwanted dissonance between derived notes or pitches.) Unison refers to the starting note, tone, pitch, and/or frequency of the scale. Octave refers to a doubling of the Unison frequency, which the human ear perceives as the same note at a higher pitch. Each of the intermediate notes is specified by their conventional designations in chord structures of Western music.

TABLE 2

| Note | Precise Temperament tuning |
|---|---|
| Unison | 1.000 |
| Minor Second | 1.058 |
| Major Second | 1.125 |
| Minor Third | 1.190 |
| Major Third | 1.26 |
| Fourth | 1.333 |
| Diminished Fifth | 1.414 |
| Fifth | 1.5 |
| Minor Sixth | 1.587 |
| Major Sixth | 1.68 |
| Minor Seventh | 1.786 |
| Major Seventh | 1.889 |
| Octave | 2.0000 |

Figure 3:
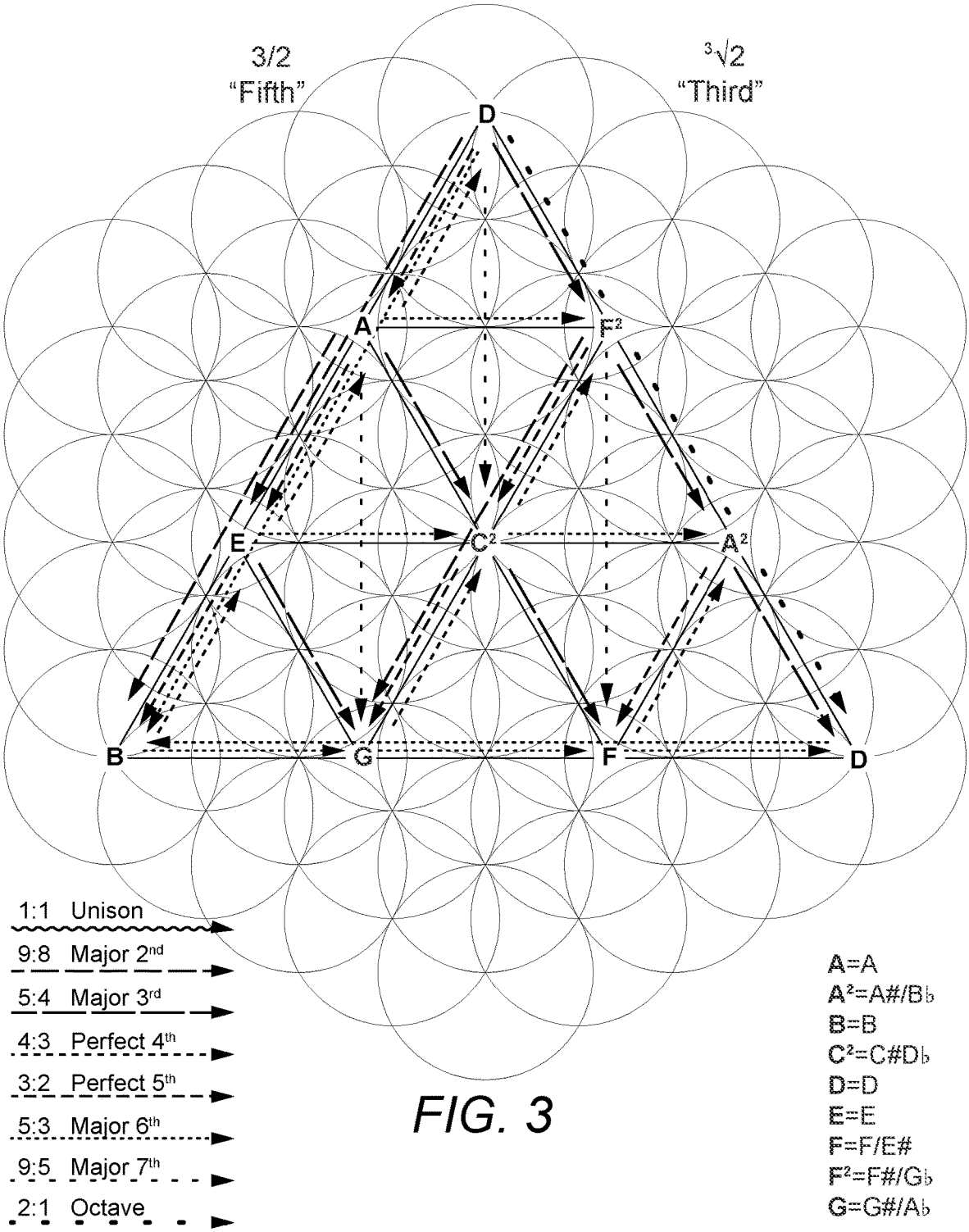
FIG. 3.

Interrelationships between the distinct notes that characterize a typical chromatic scale within a single octave using Precise Temperament tuning are shown in FIG. 3. It should be appreciated that Precise Temperament tuning preserves "pure" tones of the classic Just scale, while resolving issues with significant differences in frequencies assigned to the same note as these tuning intervals are applied to different members of the note series. For example, the interval associated with the major third in Precise Temperament tuning (i.e., 1.26) provides an octave interval of 2.0003 when cubed, which is essentially indistinguishable from the nominal value of precisely two. Precise tuning provides this while maintaining the esthetics of pure tones.

Figure 4:
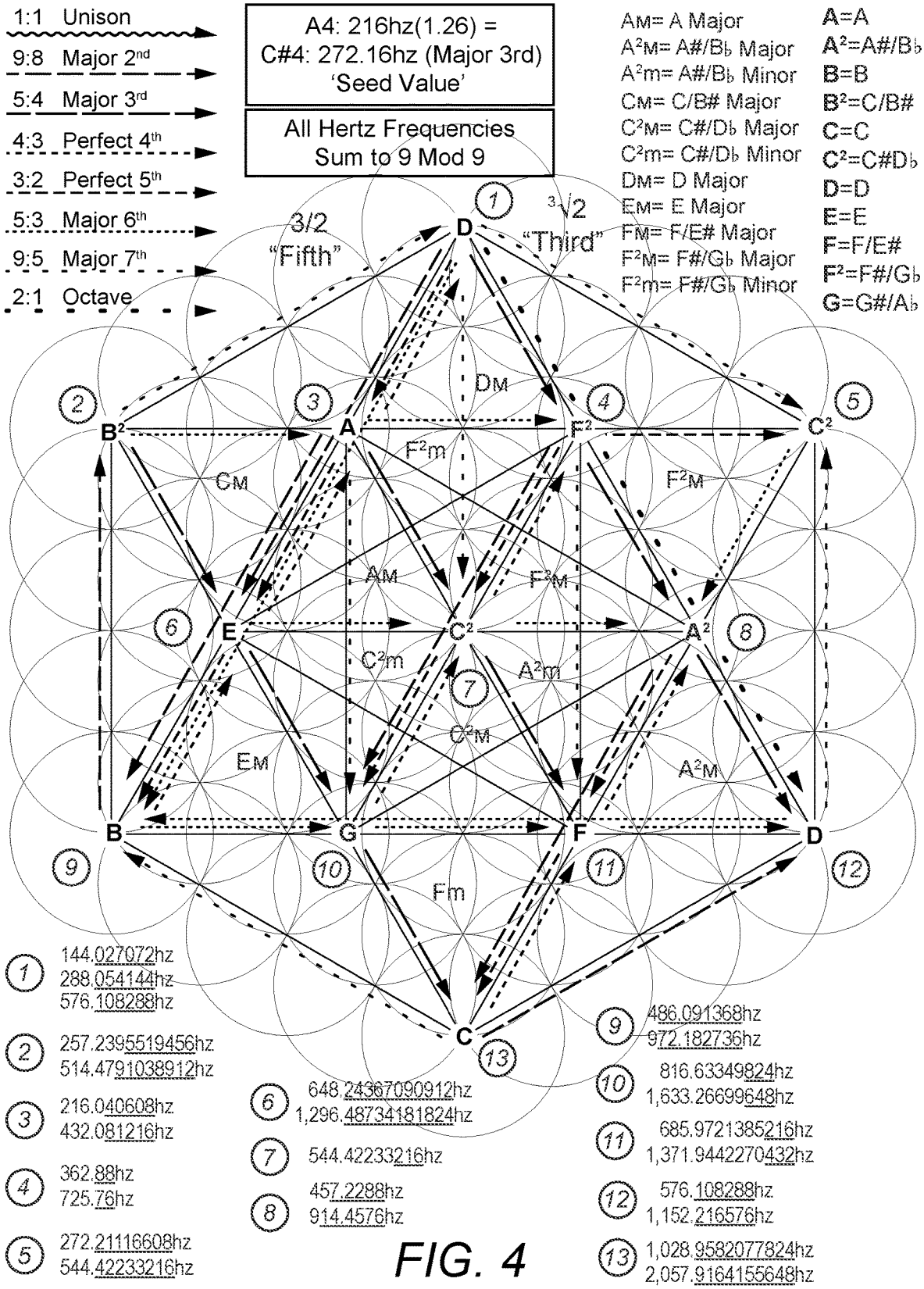
FIG. 4.

As noted above, Precise Temperament tuning can provide a reduction or elimination of perceived dissonance when two or more notes characterized by frequencies generated using the tuning system are played concurrently to provide a chord. Dissonance within chords generated across different octaves and/or by two or more musical instruments that produce different fundamental tones upon which their individual tuning is based is often noted when prior art tuning systems are applied. An example of the application to Precise Temperament tuning across multiple octaves to generate frequencies associated with specific designated notes within those octaves is shown in FIG. 4. Numerical frequencies cited in FIG. 4 and associated with each note designation are provided in Herz.

One embodiments of the inventive concept is application of the intervals or frequency multipliers noted above to apply Precise Temperament tuning to correct or adjust a note or frequency to conform to the Precise Temperament tuning intervals. Such a method can be applied to music provided on a recording medium (e.g., permanent or transient media) or received as a data stream (e.g., via a wired and/or wireless information network). Alternatively, such a method can be applied to music transmitted via a microphone and/or instrument pickup during a liver performance (e.g., autotuning). Such a method is shown in FIG. 5.

In such embodiments it is desirable to determine or assign a note identification to a sound signal received from a recording medium and/or microphone, in order to provide a basis for adjustment to the corresponding Precise Temperament note interval. This can be accomplished by any suitable means. For example, a frequency identified in an incoming signal can be matched to a stored frequency corresponding to a previously identified note, and then be designated as corresponding to the identified note. Such an identification can include a margin of error, for example having a frequency within about 0.0000001%, 0.000001%, 0.00001%, 0.0001%, 0.001%, or 0.01% of the frequency of a stored note. Alternatively, if an incoming signal includes two or more distinct frequencies an algorithm can identify the interval(s) between the two or more frequencies and correlate them with one or more sets of frequency intervals identified as characteristic of chord constructions generated using Precise Temperament intervals. Component frequencies can then be identified with the corresponding notes within the stored set of frequently intervals that provides the best match. For example, a t-test can be applied to determine an optimal match. Once specific note identities have been assigned the incoming frequencies can be adjusted to match those of corresponding notes derived using Precise Temperament tuning.

Figure 5:
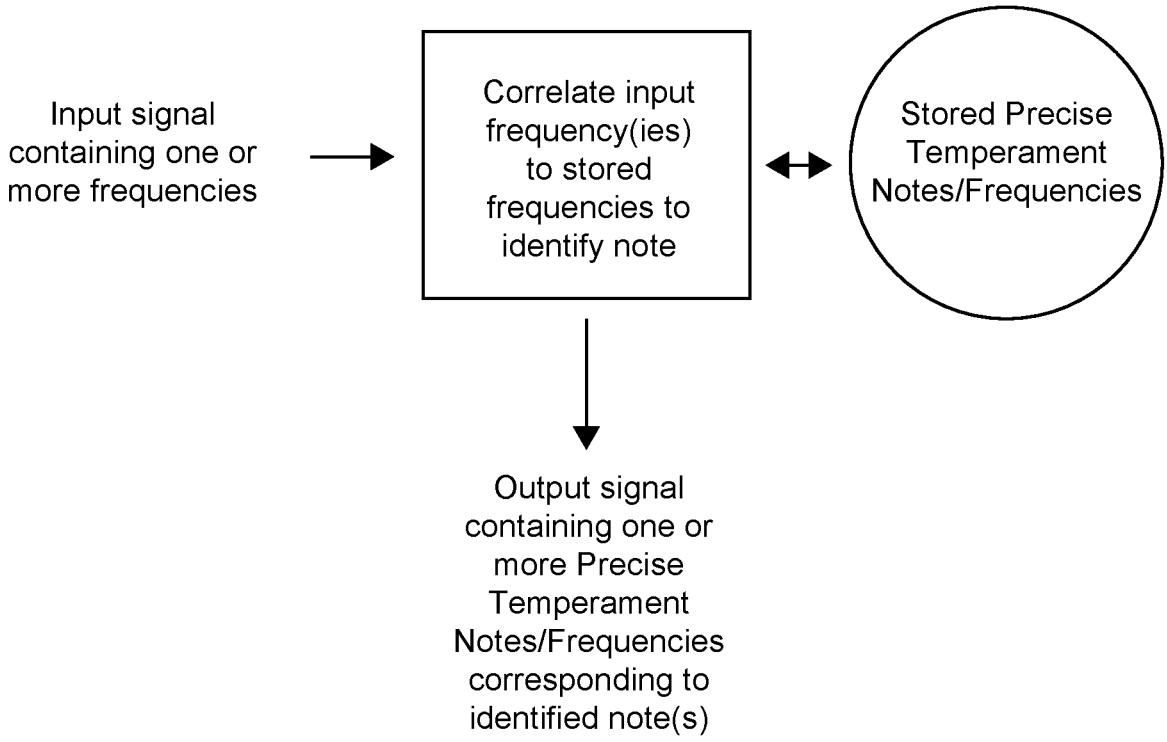
FIG. 5.

One embodiment of the inventive concept, as shown schematically in FIG. 5, is a method of adjusting a musical note by identifying a fundamental note or base note comprising or characterized by a fundamental note frequency, generating a major second note comprising or characterized by a major second note frequency from the fundamental note by multiplying the fundamental note frequency by 1.125 to generate the major second note frequency, generating a major third note comprising or characterized by a major third note frequency from the fundamental note by multiplying the fundamental note frequency by 1.26 to generate a major third note frequency, and generating a fifth note comprising or characterized by a fifth note frequency from the fundamental tone by multiplying the fundamental tone frequency by 1.5 to generate the fifth note frequency.

The fundamental note frequency, the major second note frequency, the major third note frequency, and the fifth note frequency are stored in a memory, such as a computer memory device or any suitable permanent or temporary readable media. A first input note frequency is identified as corresponding to the fundamental note, then a memory location where the fundamental note frequency is stored is identified and the fundamental note frequency transmitted to an audio emitter (such as a speaker or other audio transducer) or a storage medium. Second, third, and fourth input note frequencies are also identified as corresponding to second, third, and fourth notes (respectively). The memory locations for the corresponding second, third, and fourth note frequencies are then identified and the second, third, and fourth note frequencies transmitted from the memory to the audio emitter or storage medium. The first input note frequency, the second input note frequency, the third input note frequency, and the fourth input note frequency can be obtained from a recording medium and/or a microphone (or equivalent device).

Additional notes, tones, and/or pitches can also be derived. In some embodiment the method also includes generating a fourth note comprising or characterized by a fourth note frequency from the fundamental note by multiplying the fundamental note frequency by 1.333 to generate a fourth note frequency, storing the fourth note frequency in the memory, and identifying a fifth input note frequency as corresponding to the fourth note. The memory location where the fourth note frequency is stored is accessed, and the fourth note frequency is transmitted from the memory to the audio emitter and/or the storage medium. The fifth input note frequency can be obtained from a recording medium or a microphone.

Some embodiments of the method can include generating a minor second note comprising or characterized by a minor second note frequency from the fundamental note by multiplying the fundamental note frequency by 1.058 to generate the minor second frequency, generating a minor third note comprising or characterized by a minor third note frequency from the fundamental tone by multiplying the fundamental note frequency by 1.190 to generate the minor third note frequency, generating a diminished fifth note comprising or characterized by a diminished fifth note frequency from the fundamental note by multiplying the fundamental note frequency by 1.414 to generate the diminished fifth note frequency, generating a minor sixth note comprising or characterized by a minor sixth note frequency from the fundamental note by multiplying the fundamental note frequency by 1.587 to generate the minor sixth note frequency, generating a major sixth note comprising or characterized by a major sixth note frequency from the fundamental note by multiplying the fundamental note frequency by 1.68 to generate the major sixth note frequency, generating a minor seventh note comprising or characterized by a minor seventh note frequency from the fundamental note by multiplying the fundamental note frequency by 1.786 to generate the minor seventh note frequency, and generating a major seventh note comprising or characterized by a major seventh note frequency from the fundamental note by multiplying the fundamental note frequency by 1.889 to generate the major seventh note frequency. The minor second note frequency, the minor third note frequency, the diminished fifth note frequency, the minor sixth note frequency, the major sixth note frequency, the minor seventh note frequency, and the major seventh note frequency are stored the memory. When a sixth input note frequency is identified as corresponding to the minor second note the memory location where the minor second note frequency is stored is accessed, and the minor second note frequency is transmitted from the memory to an audio emitter or a storage medium. When a seventh input note frequency is identified as corresponding to the minor third note the memory location where the minor third note frequency is stored is accessed, and the minor third note frequency is transmitted from the memory to an audio emitter or a storage medium. When an eighth input note frequency is identified as corresponding to the diminished fifth note the memory location where the diminished fifth note frequency is stored is accessed, and the diminished fifth note frequency is transmitted from the memory to an audio emitter or a storage medium. When a ninth input note frequency is identified as corresponding to the minor sixth note the memory location where the minor sixth note frequency is stored is accessed, and the minor sixth note frequency is transmitted from the memory to an audio emitter or a storage medium When a tenth input note frequency is identified as corresponding to the major sixth note the memory location where the major sixth note frequency is stored is accessed, and the major sixth note frequency is transmitted from the memory to an audio emitter or a storage medium. When an eleventh input note frequency is identified as corresponding to the minor seventh note the memory location where the minor seventh note frequency is stored is accessed, and the minor seventh note frequency is transmitted from the memory to an audio emitter or a storage medium. When a twelfth input note frequency is identified as corresponding to the major seventh note the memory location where the major seventh note frequency is stored is accessed, and the major seventh note frequency is transmitted from the memory to an audio emitter or a storage medium. The sixth input note frequency, the seventh input note frequency, the eighth input note frequency, the ninth input note frequency, the tenth input note frequency, the eleventh input note frequency, and the twelfth input note frequency can be obtained from a microphone or a storage medium.

It should be appreciated that the frequency multipliers of the Precise Temperament tuning system can be applied to a method of tuning a fixed interval musical instrument. In such a method a fundamental tone of the fixed tone musical instrument is identified. This varies with the type of musical instrument. For example, for a wind instrument with a number of valves or keys the fundamental tone is frequently a tone or frequency generated with none of the keys or valves depressed and using a basic embouchure (for example, the oboe's A). For a string instrument it can be a tone or frequency generated by a selected string without impelling the string into a fret. For a keyboard instrument it can be a tone or frequency generated when a selected key is pressed or otherwise activated (such as middle C on a piano).

Fixed interval instruments, as described above, typically include two or more mechanisms used to generate a plurality of fixed intervals from this fundamental tones. These mechanisms can provide physical embodiment of the frequency multipliers of the Precise Temperament tuning method. The fundamental tone represents a fundamental frequency, which mechanisms or actuators of the fixed interval musical instruments modifies to produce a frequency associated with the desired tone or note. Using Precise Temperament tuning the method generates a minor second tone of the fundamental tone by multiplying the fundamental frequency by 1.058 to generate a minor second frequency followed by adjusting a first fixed interval of the musical instrument to emit the minor second frequency when the first fixed interval is actuated, generates a major second tone of the fundamental tone by multiplying the fundamental frequency by 1.125 to generate a major second frequency followed by adjusting a second fixed interval of the musical instrument to emit the major second frequency when the second fixed interval is actuated, generates a minor third tone of the fundamental tone by multiplying the fundamental frequency by 1.190 to generate a minor third frequency, followed by adjusting a third fixed interval of the musical instrument to emit the minor third frequency when the third fixed interval is actuated, generates a major third tone of the fundamental tone by multiplying the fundamental frequency by 1.26 to generate a major third frequency followed by adjusting a fourth fixed interval of the musical instrument to emit the major third frequency when the fourth fixed interval is actuated, generates a fourth tone of the fundamental tone by multiplying the fundamental frequency by 1.333 to generate a fourth frequency followed by adjusting a fifth fixed interval of the musical instrument to emit the fourth frequency when the fifth fixed interval is actuated, generates a diminished fifth tone of the fundamental tone by multiplying the fundamental frequency by 1.414 to generate a diminished fifth frequency, followed by adjusting a sixth fixed interval of the musical instrument to emit the diminished fifth frequency when the sixth fixed interval is actuated, generates a fifth tone of the fundamental tone by multiplying the fundamental frequency by 1.5 to generate a fifth frequency followed by adjusting a seventh fixed interval of the musical instrument to emit the fifth frequency when the seventh fixed interval is actuated, generates a minor sixth tone of the fundamental tone by multiplying the fundamental frequency by 1.587 to generate a minor sixth frequency followed by adjusting an eighth fixed interval of the musical instrument to emit the minor sixth frequency when the eighth fixed interval is actuated, generates a major sixth tone of the fundamental tone by multiplying the fundamental frequency by 1.68 to generate a major sixth frequency followed by adjusting a ninth fixed interval of the musical instrument to emit the major sixth frequency when the ninth fixed interval is actuated, generates a minor seventh tone of the fundamental tone by multiplying the fundamental frequency by 1.786 to generate a minor seventh frequency followed by adjusting a tenth fixed interval of the musical instrument to emit the minor seventh frequency when the tenth fixed interval is actuated, and generates a major seventh tone of the fundamental tone by multiplying the fundamental frequency by 1.889 to generate a major seventh frequency followed by adjusting an eleventh fixed interval of the musical instrument to emit the major seventh frequency when the eleventh fixed interval is actuated.

One group of fixed interval musical instruments is characterized by having a keyboard containing from 2 to 88 or more keys, each of which is associated with a distinct note, tone or pitch. Mechanisms used to generate the note, tone, or pitch vary by instruments. For example, a piano utilizes tensioned wires that are hammered to set them into vibration and so produce sound. A harpsichord utilizes a similar arrangement in which the wires or strings are plucked rather than hammered. An organ uses a similar keyboard to actuate valves that are in communication with a source of pressured air that is directed over apertures in a set of pipes, each of which generates a designated tone, note or pitch via a vibrating column of air. An accordion includes a set of bellows and valves that direct air to a set of reeds, each of which generates a defined pitch, note, or frequency. In such instruments the keyboard in conjunction with the associated sound-generating mechanisms constitute actuators a user can trigger to generate a desired note, tone, or pitch. As noted above, the mechanisms or actuators used to implement frequency multipliers of the Precise Temperament tuning method vary depending upon the nature of the fixed interval musical instrument. To implement Precise Temperament tuning such lengths are generated or selected by applying the inverse of the frequency multipliers of the method to generate the desired notes or tones (e.g., to a string or wire generating an octave of the fundamental tone or note would be set to half of the length of the string or wire generating the fundamental tone or note). For example, a fixed intervals can include a series of strings or wires, and the series of strings represent a first, second, third, fourth, fifth, sixth, seventh, eighth, ninth, tenth, and eleventh strings having lengths adjusted to generate the minor second frequency, the major second frequency, the minor third frequency, the major third frequency, the fourth frequency, the diminished fifth frequency, the fifth frequency, the minor sixth frequency, the major sixth frequency, the minor seventh frequency, and the major seventh frequency, respectively, when set into vibrational motion. In some embodiments the first, second, third, fourth, fifth, sixth, seventh, eighth, ninth, tenth, and eleventh strings having tensions adjusted to generate the minor second frequency, the major second frequency, the minor third frequency, the major third frequency, the fourth frequency, the diminished fifth frequency, the fifth frequency, the minor sixth frequency, the major sixth frequency, the minor seventh frequency, and the major seventh frequency generated by application of the multipliers or intervals of the Precise Temperament tuning method to a fundamental tone/frequency/note, respectively. Sound producing mechanisms in such keyboard instruments can be adjusted to implement Precise Temperament tuning by any suitable method, for example adjustment of length and/or tension of sound producing wires or strings, adjustment of length of a pipe, and/or adjustment of position of a reed and/or length of tubing associated with a reed.

As noted above, the mechanisms or actuators used to implement frequency multipliers of the Precise Temperament tuning method vary depending upon the nature of the fixed interval musical instrument. In some embodiments the fixed interval instrument is a string instrument. In such instruments sound is produced by the vibration of a string or wire, which can be initiated by actions such as strumming, plucking, striking, and/or contact with a moving surface (such as a bow). The frequency or tone produced is a function of both the length of the string or wire and the tension that it is under. For most fixed interval string instruments, a musician either modifies the length of a selected string or wire (for example, by impelling the string or wire against a fret) and/or selects a string or wire of the desired length. To implement Precise Temperament tuning such lengths are generated or selected by applying the inverse of the frequency multipliers of the method to generate the desired notes or tones (e.g., to a string or wire generating an octave of the fundamental tone or note would be set to half of the length of the string or wire generating the fundamental tone or note). For example, a fixed intervals can include a series of strings or wires, and the series of strings represent a first, second, third, fourth, fifth, sixth, seventh, eighth, ninth, tenth, and eleventh strings having lengths adjusted to generate the minor second frequency, the major second frequency, the minor third frequency, the major third frequency, the fourth frequency, the diminished fifth frequency, the fifth frequency, the minor sixth frequency, the major sixth frequency, the minor seventh frequency, and the major seventh frequency, respectively, when set into vibrational motion. In some embodiments the first, second, third, fourth, fifth, sixth, seventh, eighth, ninth, tenth, and eleventh strings having tensions adjusted to generate the minor second frequency, the major second frequency, the minor third frequency, the major third frequency, the fourth frequency, the diminished fifth frequency, the fifth frequency, the minor sixth frequency, the major sixth frequency, the minor seventh frequency, and the major seventh frequency generated by application of the multipliers or intervals of the Precise Temperament tuning method to a fundamental tone/frequency/note, respectively, when set into vibrational motion.

In some embodiments the fixed intervals is a string instrument that includes a neck having a plurality of frets, and a plurality of strings arranged along the neck and positioned to be brought into contact with the frets by a user. Such frets (and their associated positions along the neck of the instrument) are, effectively, actuators that can be implemented by a user to generate a desired note, tone, and/or frequency. In such embodiments such frets are positioned and/or arranged along the neck to reflect the frequency multipliers/intervals of the Precise Temperament tuning method as described above to generate the minor second frequency, the major second frequency, the minor third frequency, the major third frequency, the fourth frequency, the diminished fifth frequency, the fifth frequency, the minor sixth frequency, the major sixth frequency, the minor seventh frequency, and the major seventh frequency, respectively, when strings selected by the user are impelled into the frets and set into vibrational motion. Similarly, in such instruments with multiple strings tensions of one or more individual strings can be adjusted to reflect these multipliers or intervals so as to generate the desired note, tone, or frequency relative to another string.

In some embodiments the fixed interval instrument is a wind instrument, which can be a woodwind or a brass instrument. Typically, a wind instrument comprises a mouthpiece configured to provide an oscillating air pressure, for example by providing an opening that provides a volume of vibrating air when an air stream is directed over it, one or two reeds that vibrate when air is passed over it/them (for a woodwind instrument), or a mouthpiece that supports a user's embouchure (for a brass instrument). Such a wind instrument also includes a wall that encloses an air column that is in fluid communication with the oscillating air pressure. This provides a vibrating air column that generates the desired note, tone, and/or frequency.

In typical woodwind fixed interval instruments this wall can include a of openings or apertures, and the effective length of the air column is modified by obstructing or removing an obstruction from one or more of these. Such openings and apertures and the mechanisms used to occlude them are, effectively, actuators that can be implemented by a user to generate a desired note, tone, and/or frequency. To implement the Precise Temperament tuning method the position of these apertures can be selected to reflect the frequency multipliers/intervals described above. For example, some wind instruments can include a first, second, third, fourth, fifth, sixth, seventh, eighth, ninth, tenth, and eleventh configurations of obstructed and/or open apertures that provide a series of effective lengths of the vibrating air columns that are effective to generate the minor second frequency, the major second frequency, the minor third frequency, the major third frequency, the fourth frequency, the diminished fifth frequency, the fifth frequency, the minor sixth frequency, the major sixth frequency, the minor seventh frequency, and the major seventh frequency based on a fundamental note or tone of the fixed interval wind instruments.

In some embodiments the fixed interval wind instrument is a brass instrument that has a mouthpiece configured to provide an oscillating air pressure and a wall that encloses an air column that is in fluid communication with the oscillating air pressure (thereby providing a vibrating air column), a first valve in fluid communication with the vibrating air column and with a first tube, such that actuation of the first valve connects the air column in communication with the first tube, a second valve in fluid communication with the vibrating air column and with a second tube, such that actuation of the second valve connects the air column in communication with the second tube, and a third valve in fluid communication with the vibrating air column and with a third tube, such that actuation of the third valve connects the air column in communication with the third tube. Activating such valves (e.g., by pressing a pad or trigger) brings the associated length of tubing into communication with the vibrating column of air, effectively changing its length and the note, tone, and/or frequency produced by the instrument. Such valves can be used individually or in combination. Such valves and their associated lengths of tubing are, effectively, actuators that can be implemented by a user to generate a desired note, tone, and/or frequency. The first, second, and third valves and their associated lengths of tubing are configured to provide a first, second, third, fourth, fifth, sixth, seventh, eighth, ninth, tenth, and eleventh configurations that provide a series of effective lengths of the vibrating air columns that are effective to generate the minor second frequency, the major second frequency, the minor third frequency, the major third frequency, the fourth frequency, the diminished fifth frequency, the fifth frequency, the minor sixth frequency, the major sixth frequency, the minor seventh frequency, and the major seventh frequency.

In some embodiments the fixed interval instrument is a percussion instrument that has a two or more percussive surfaces that each generate a distinct note, tone, and/or frequency when struck. Such percussive surfaces are, effectively, actuators that can be implemented by a user to generate a desired note, tone, and/or frequency. These percussive surfaces are dimensioned and/or tensioned to generate the minor second frequency, the major second frequency, the minor third frequency, the major third frequency, the fourth frequency, the diminished fifth frequency, the fifth frequency, the minor sixth frequency, the major sixth frequency, the minor seventh frequency, and the major seventh frequency, respectively, when percussive surfaces selected by a user are struck.

In some embodiments the fixed interval instrument is an electronic instrument that has one or more oscillators. Such oscillators are, effectively, actuators that can be implemented by a user to generate a desired note, tone, and/or frequency. In some embodiments the electronic instrument includes a first, second, third, fourth, fifth, sixth, seventh, eighth, ninth, tenth, and eleventh oscillator configured to generate the minor second frequency, the major second frequency, the minor third frequency, the major third frequency, the fourth frequency, the diminished fifth frequency, the fifth frequency, the minor sixth frequency, the major sixth frequency, the minor seventh frequency, and the major seventh frequency, respectively, when actuated. Such a fixed interval electronic instrument can be a virtual instrument, and such a virtual instrument can be embodied as an application on a portable electronic device.

In some embodiments the electronic fixed interval instrument has an oscillator configured to generate two or more notes, tones, and/or frequencies. Such an oscillator and the mechanisms and/or circuitry utilized to select the note, tone, and/or frequency produced is, effectively, a set of actuators that can be implemented by a user to generate a desired note, tone, and/or frequency. of the minor second frequency, the major second frequency, the minor third frequency, the major third frequency, the fourth frequency, the diminished fifth frequency, the fifth frequency, the minor sixth frequency, the major sixth frequency, the minor seventh frequency, and the major seventh frequency, respectively, when actuated. Such a fixed interval electronic instrument can be a virtual instrument, and such a virtual instrument can be embodied as an application on a portable electronic device.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of tuning a fixed interval musical instrument, comprising:

identifying a fundamental note of the fixed interval musical instrument, wherein the fundamental note comprises a fundamental note frequency;

generating a major second note comprising a major second note frequency from the fundamental note by multiplying the fundamental note frequency by 1.125 to generate the major second note frequency;

generating a major third note comprising a major third note frequency from the fundamental note by multiplying the fundamental note frequency by 1.26 to generate a major third note frequency;

generating a fifth note comprising a fifth note frequency from the fundamental note by multiplying the fundamental note frequency by 1.5 to generate the fifth note frequency;

configuring a first fixed interval of the fixed interval musical instrument to generate the major second note frequency;

configuring a second fixed interval of the fixed interval musical instrument to generate the major third note frequency; and configuring a third fixed interval of the fixed interval musical instrument to generate the fifth note frequency.

2. The method of claim 1, comprising;

generating a fourth note comprising a fourth note frequency from the fundamental note by multiplying the fundamental note frequency by 1.333 to generate a fourth note frequency; and configuring a fourth fixed interval of the fixed interval musical instrument to generate the fourth note frequency.

3. The method of claim 1, comprising;

generating a minor second note comprising a minor second note frequency from the fundamental note by multiplying the fundamental note frequency by 1.058 to generate the minor second frequency;

generating a minor third note comprising a minor third note frequency from the fundamental note by multiplying the fundamental note frequency by 1.190 to generate the minor third note frequency;

generating a diminished fifth note comprising a diminished fifth note frequency from the fundamental note by multiplying the fundamental note frequency by 1.414 to generate the diminished fifth note frequency;

generating a minor sixth note comprising a minor sixth note frequency from the fundamental note by multiplying the fundamental note frequency by 1.587 to generate the minor sixth note frequency;

generating a major sixth note comprising a major sixth note frequency from the fundamental note by multiplying the fundamental note frequency by 1.68 to generate the major sixth note frequency;

generating a minor seventh note comprising a minor seventh note frequency from the fundamental note by multiplying the fundamental note frequency by 1.786 to generate the minor seventh note frequency;

generating a major seventh note comprising a major seventh note frequency from the fundamental note by multiplying the fundamental note frequency by 1.889 to generate the major seventh note frequency;

configuring a fifth fixed interval of the fixed interval musical instrument to generate the minor second note frequency;

configuring a sixth fixed interval of the fixed interval musical instrument to generate the minor third note frequency;

configuring a seventh fixed interval of the fixed interval musical instrument to generate the diminished fifth note frequency;

configuring an eighth fixed interval of the fixed interval musical instrument to generate the minor sixth note frequency;

configuring a ninth fixed interval of the fixed interval musical instrument to generate the major sixth note frequency configuring a tenth fixed interval of the fixed interval musical instrument to generate the minor seventh note frequency; and configuring an eleventh fixed interval of the fixed interval musical instrument to generate the major seventh note frequency.

4. The method of claim 1, wherein the fixed interval musical instrument is a string instrument.

5. The method of claim 4, wherein the first, second, and third fixed intervals comprise a series of strings or wires.

6. The method of claim 5, wherein the series of strings comprise a first, second, third, and fourth strings having lengths configured to generate the fundamental note frequency, the major second note frequency, the major third note frequency, and the fifth note frequency, respectively, when set into vibrational motion.

7. The method of claim 6, wherein the fixed intervals comprises a neck comprising a plurality of frets, and a plurality of strings arranged in series along the neck to provide the series of strings, wherein the plurality of strings is positioned to be brought into contact with the plurality of frets by a user.

8. The method of claim 7, wherein a subset of the plurality of frets are arranged to effectively modify the lengths of one or more of the plurality of strings when the one or more of the plurality of strings are pressed against one or more of the subset of frets by a user, and wherein the subset of the plurality of frets is arranged along the neck to generate one or more of the major second note frequency, the major third note frequency, and the fifth note frequency when the one or more of the plurality of strings as selected by the user are impelled into the one or more of the subset of frets and set into vibrational motion.

9. The method of claim 5, wherein the series of strings comprise a first, second, third, and fourth strings having tensions configured to generate the fundamental note frequency, the major second note frequency, the major third note frequency, and the fifth note frequency, respectively, when set into vibrational motion.

* * * * *